US011278170B2

(12) United States Patent
Trebino

(10) Patent No.: US 11,278,170 B2
(45) Date of Patent: Mar. 22, 2022

(54) ADJUSTABLE TOILET SEAT

(71) Applicant: Andrew Trebino, Carlisle, MA (US)

(72) Inventor: Andrew Trebino, Carlisle, MA (US)

( * ) Notice: Subject to any disclaimer, the term of this patent is extended or adjusted under 35 U.S.C. 154(b) by 0 days.

(21) Appl. No.: 17/023,191

(22) Filed: Sep. 16, 2020

(65) Prior Publication Data

US 2021/0076888 A1 Mar. 18, 2021

Related U.S. Application Data

(60) Provisional application No. 62/900,943, filed on Sep. 16, 2019.

(51) Int. Cl.
*A47K 13/28* (2006.01)

(52) U.S. Cl.
CPC ..... *A47K 13/28* (2013.01)

(58) Field of Classification Search
CPC ..... A47K 13/28
USPC ..... 4/237, 238, 239, 240, 236, 241; 297/188.09, 250.1; 234/217, 98
See application file for complete search history.

(56) References Cited

U.S. PATENT DOCUMENTS

| | | | | |
|---|---|---|---|---|
| 6,189,160 | B1 * | 2/2001 | Pettus | A47K 13/10 4/246.1 |
| 2001/0004776 | A1 * | 6/2001 | Fujita | A47K 13/12 4/236 |
| 2014/0259341 | A1 * | 9/2014 | Henderson | A47K 13/10 4/246.2 |
| 2018/0325337 | A1 * | 11/2018 | Kim | A47K 17/02 |
| 2021/0244243 | A1 * | 8/2021 | Sharon | A47K 17/028 |

* cited by examiner

*Primary Examiner* — Lori L Baker

(57) ABSTRACT

An adjustable toilet seat that adjust according to the applied weight of the user includes a left seat body, a right seat body, a first self-closing barrel hinge, a second self-closing barrel hinge, and a seat connector. The first self-closing barrel hinge is terminally integrated into the left seat body. The second self-closing barrel hinge is terminally integrated into the right seat body. The left seat body and the right seat body are rotatably engaged with each other through the first and second self-closing barrel hinge so that the left seat body and the right seat body can expand and collapse about the two barrel hinges. The seat connector is oppositely positioned of the first and second self-closing barrel hinge. The left seat body and the right seat body are slidably mounted to the seat connector so that both seat bodies can slidably expand and collapse along the seat connector.

8 Claims, 9 Drawing Sheets

ADJUSTABLE TOILET SEAT

The current application claims a priority to the U.S. Provisional Patent application Ser. No. 62/900,943 filed on Sep. 16, 2019.

FIELD OF THE INVENTION

The present invention generally relates to a toilet seat. More specifically, the present invention relates to a toilet seat in which adjusts in width with an applied force.

BACKGROUND OF THE INVENTION

Toilets seats are a common everyday item that allow the user to comfortably sit on the toilet bowl. All of the existing toilet seats are rigid bodies and only rotate up and down with respect to the attachment point between the toilet seat and the toilet bowl. Current toilet seats only come in one size and are not adjustable in width or length. However, humans come in many shapes and sizes and a single toilet seat size may not be the most comfortable for all users. As a result, plus size users generally encounter constrict and uncomfortable experience when they have to sit on the standard size toilet seats.

An objective of the present design is to provide the user with a toilet seat that is adjustable in width by simply sitting on the seat. The present invention secures to the toilet bowl similar to the standard toilet seats but expands in width proportionally to the weight of the user. More specifically, a left portion and a right portion of the toilet seat expand about a front rotational point that is concentric to an integrated self-closing hinged mechanism. This allows the user to comfortably use the restroom without having to manually adjust the toilet seat or feeling uneasy. Once the applied weight is withdrawn from the present invention, the toilet seat collapse back into the original closed configuration due to the self-closing hinged mechanism.

DETAIL DESCRIPTIONS OF THE INVENTION

Figure 1:
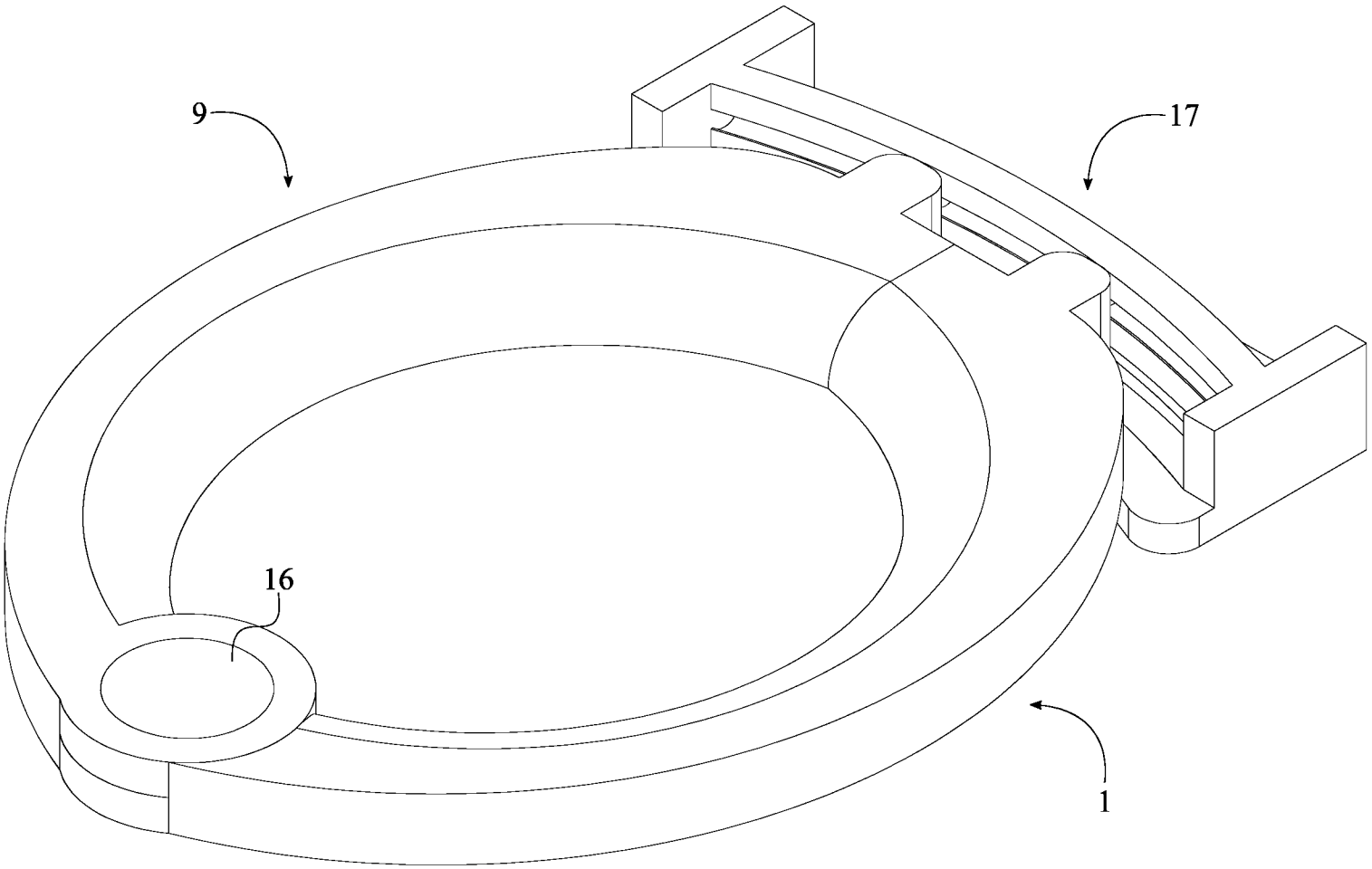
FIG. 1 is a top perspective view of the present invention, wherein the present invention is at the closed configuration.
Figure 2:
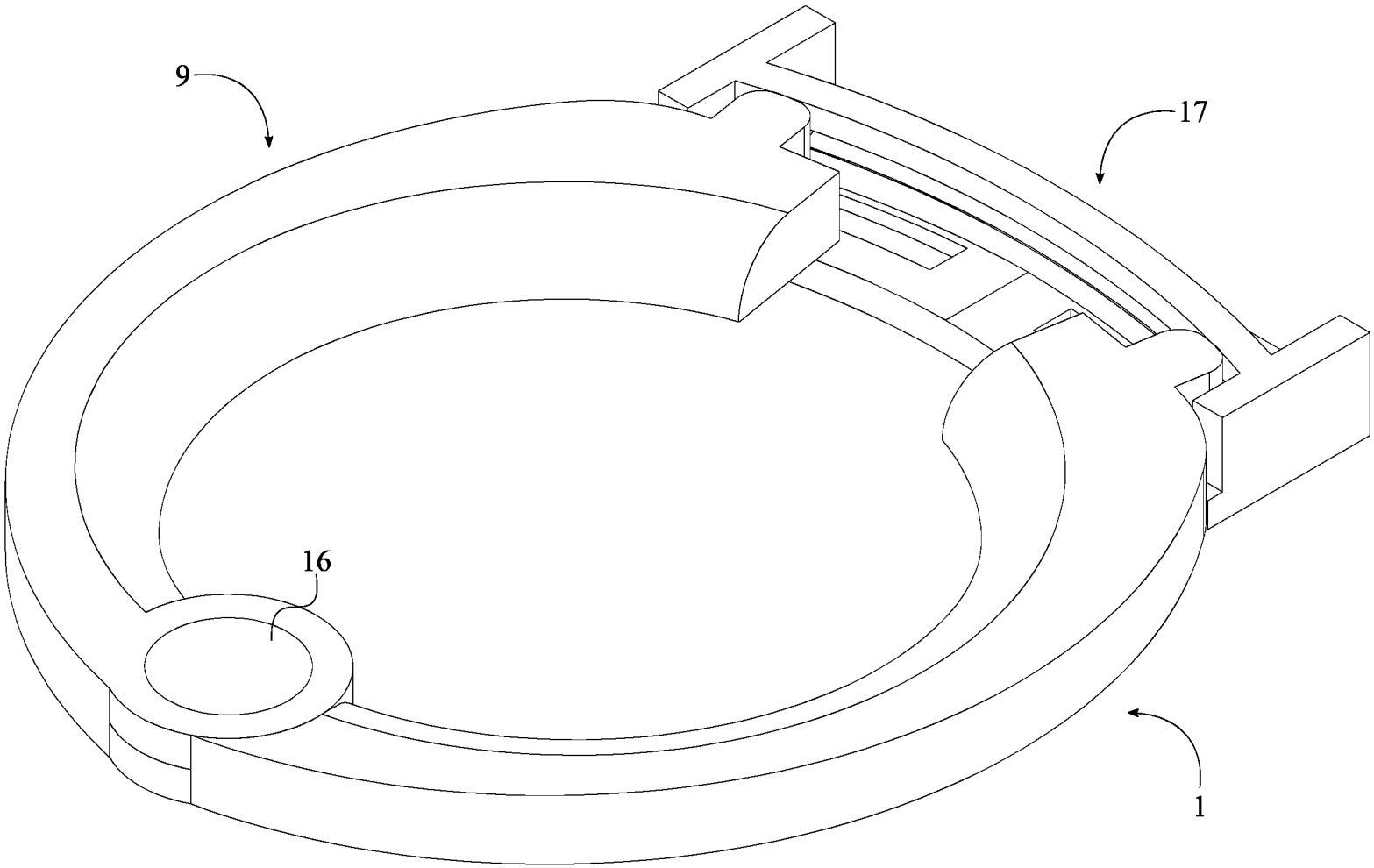
FIG. 2 is a top perspective view of the present invention, wherein the present invention is at the opened configuration.
Figure 3:
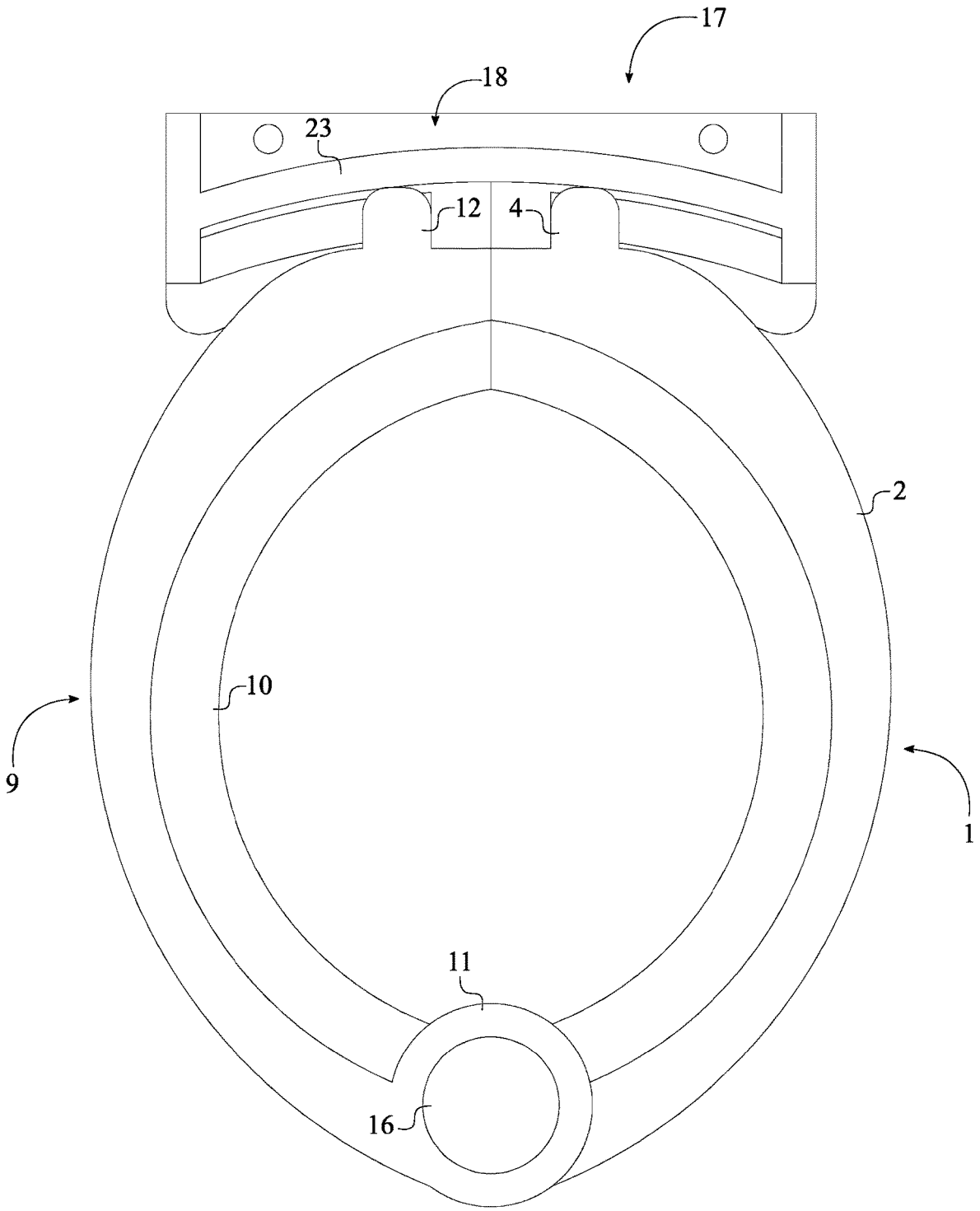
FIG. 3 is a top view of the present invention, wherein the present invention is at the closed configuration.
Figure 4:
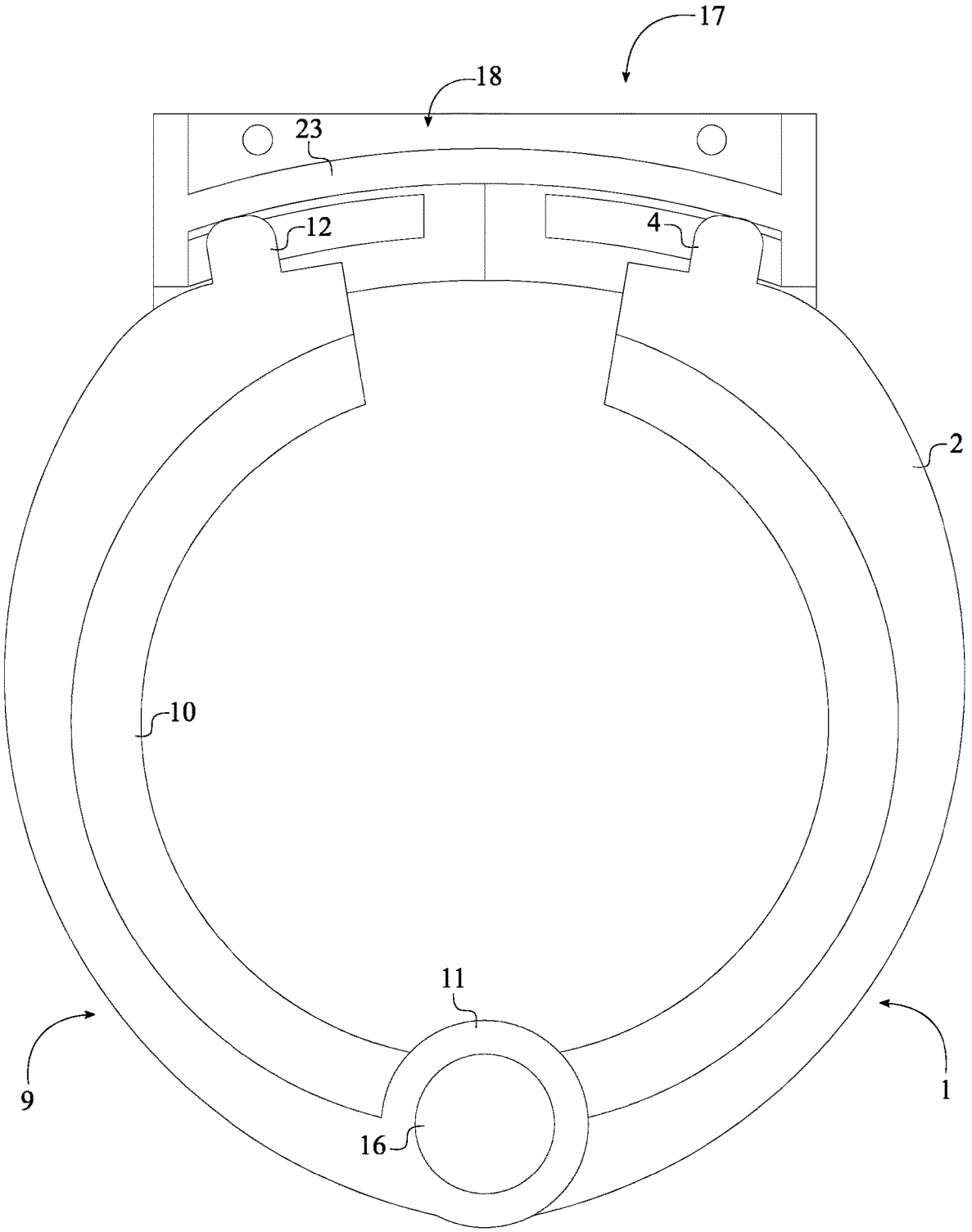
FIG. 4 is a top view of the present invention, wherein the present invention is at the opened configuration.

All illustrations of the drawings are for the purpose of describing selected versions of the present invention and are not intended to limit the scope of the present invention.

The present invention is an adjustable toilet seat that changes in width with an applied force/weight of the user. More specifically, the present invention changes from a closed configuration to an opened configuration when force is applied onto the present invention. Once the applied weight is withdrawn from the present invention, the toilet seat collapse back into the closed configuration due to an integrated self-closing hinged mechanism. The present invention comprises a left seat body 1, a right seat body 9, a first self-closing barrel hinge 15, a second self-closing barrel hinge 16, and a seat connector 17 as shown in FIG. 1-5.

In reference to a general configuration of the present invention, the first self-closing barrel hinge 15 is terminally integrated into the left seat body 1 thus delineating a left half of present invention. The second self-closing barrel hinge 16 is terminally integrated into the right seat body 9 so that a right half of the present invention can be formed. The left seat body 1 and the right seat body 9 are rotatably engaged with each other through the first self-closing barrel hinge 15 and the second self-closing barrel hinge 16 in order to shift the present invention in between the closed configuration and the opened configuration. The seat connector 17 is oppositely positioned of the first self-closing barrel hinge 15 and the second self-closing barrel hinge 16 so that the left seat body 1 and the right seat body 9 can be operationally mounted to the toilet bowl. More specifically, the left seat body 1 is slidably mounted to the seat connector 17 so that the left seat body 1 can move between the closed configuration and the opened configuration while being engaged to the toilet bowl. Similarly, the right seat body 9 is slidably mounted to the seat connector 17 so that the right seat body 9 can move between the closed configuration and the opened configuration while being engaged to the toilet bowl. As a result, user's weight equally distributed amongst the left seat body 1 and the right seat body 9 thus radially and outwardly pushing out the left seat body 1 and the right seat body 9.

The left seat body 1 is generally configured to place on top of the left portion of the toilet bowl. In reference to FIG. 5-6, the left seat body 1 comprises a left concaved section 2, a left rotational section 3, a left arm section 4, at least one left wheel 7, and a left knob 8. The left rotational section 3 and the left arm section 4 are oppositely positioned of each other about the left concaved section 2, wherein a front end of the left seat body 1 is delineated with the left rotational section 3 and a rear end of the left seat body 1 is delineated with the left arm section 4. More specifically, the left rotational section 3 that is generally formed into a cylindrical body is adjacently connected to the left concaved section 2. The left concaved section 2 is a curved body so that the left concaved section 2 can extend along the left portion of the toilet bowl. The left arm section 4 is laterally connected to the left concaved section 2 and orients toward the seat connector 17. The left arm section 4 functions as the base structure and provides sufficient surface area to integrate the left wheel 7 and the left knob 8. In other words, the left wheel 7 that facilitates the slidable movement of the left seat body 1 is rotatably mounted to a bottom surface 5 of the left arm section 4. The left knob 8 that facilitates the connection of the left seat body 1 to the seat connector 17 is laterally connected to a rear surface 6 of the left arm section 4. The left wheel 7 and the left knob 8 are perpendicularly positioned of each other in order to improve the structural integrity of the two different connection points of the left seat body 1.

Figure 7:
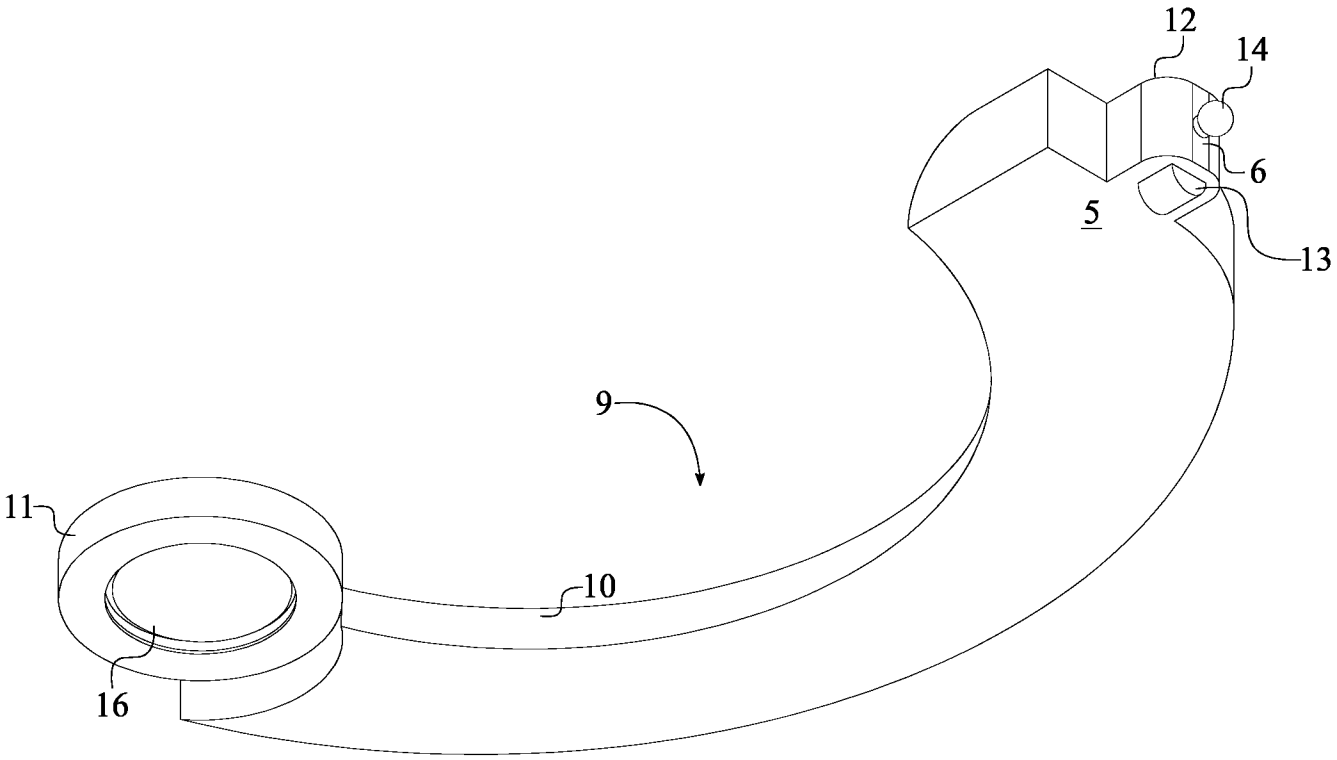
FIG. 7 is a bottom perspective view of the right seat body of the present invention.

The right seat body 9 is generally configured to place on top of the right portion of the toilet bowl. In reference to FIG. 5 and FIG. 7, the right seat body 9 comprises a right concaved section 10, a right rotational section 11, a right arm section 12, at least one right wheel 13, and a right knob 14.

The right rotational section 11 and the right arm section 12 are oppositely positioned of each other about the right concaved section 10, wherein a front end of the right seat body 9 is delineated with the right rotational section 11 and a rear end of the right seat body 9 is delineated with the right arm section 12. More specifically, the right rotational section 11 that is generally formed into a cylindrical body is adjacently connected to the right concaved section 10. The right concaved section 10 is a curved body so that the right concaved section 10 can extend along the right portion of the toilet bowl. The right arm section 12 is laterally connected to the right concaved section 10 and orients toward the seat connector 17. The right arm section 12 functions as the base structure and provides sufficient surface area to integrate the right wheel 13 and the right knob 14. In other words, the right wheel 13 that facilitates the slidable movement of the right seat body 9 is rotatably mounted to a bottom surface 5 of the right arm section 12. The right knob 14 that facilitates the connection of the right seat body 9 to the seat connector 17 is laterally connected to a rear surface 6 of the right arm section 12. The right wheel 13 and the right knob 14 are perpendicularly positioned of each other in order to improve the structural integrity of the two different connection points of the right seat body 9.

Furthermore, the thickness of the left rotational section 3 is smaller than the thickness of the left concaved section 2. The thickness of the right rotational section 11 is smaller than the thickness of the right concaved section 10. Resultantly, the left rotational section 3 and the right rotational section 11 can be concentrically positioned with each other to enable the radial movement of the left seat body 1 and the right seat body 9. In reference to FIG. 5, the first self-closing barrel hinge 15 is concentrically integrated into the left rotational section 3. The second self-closing barrel hinge 16 is concentrically integrated into the right rotational section 11. Due to the concentric positioning of the left rotational section 3 and the right rotational section 11, the first self-closing barrel hinge 15 is concentrically positioned atop the second first self-closing barrel hinge 15 and compressionally engaged with each other. In other words, the first self-closing barrel hinge 15 and the second self-closing barrel hinge 16 respectively compress the left seat body 1 and the right seat body 9 towards a sagittal plane of the seat connector 17 thus delineating the closed configuration. When the user's weight is applied upon the left seat body 1 and the right seat body 9, the present invention changes from the closed configuration to the opened configuration due to radial and outward weight distribution.

Figure 5:
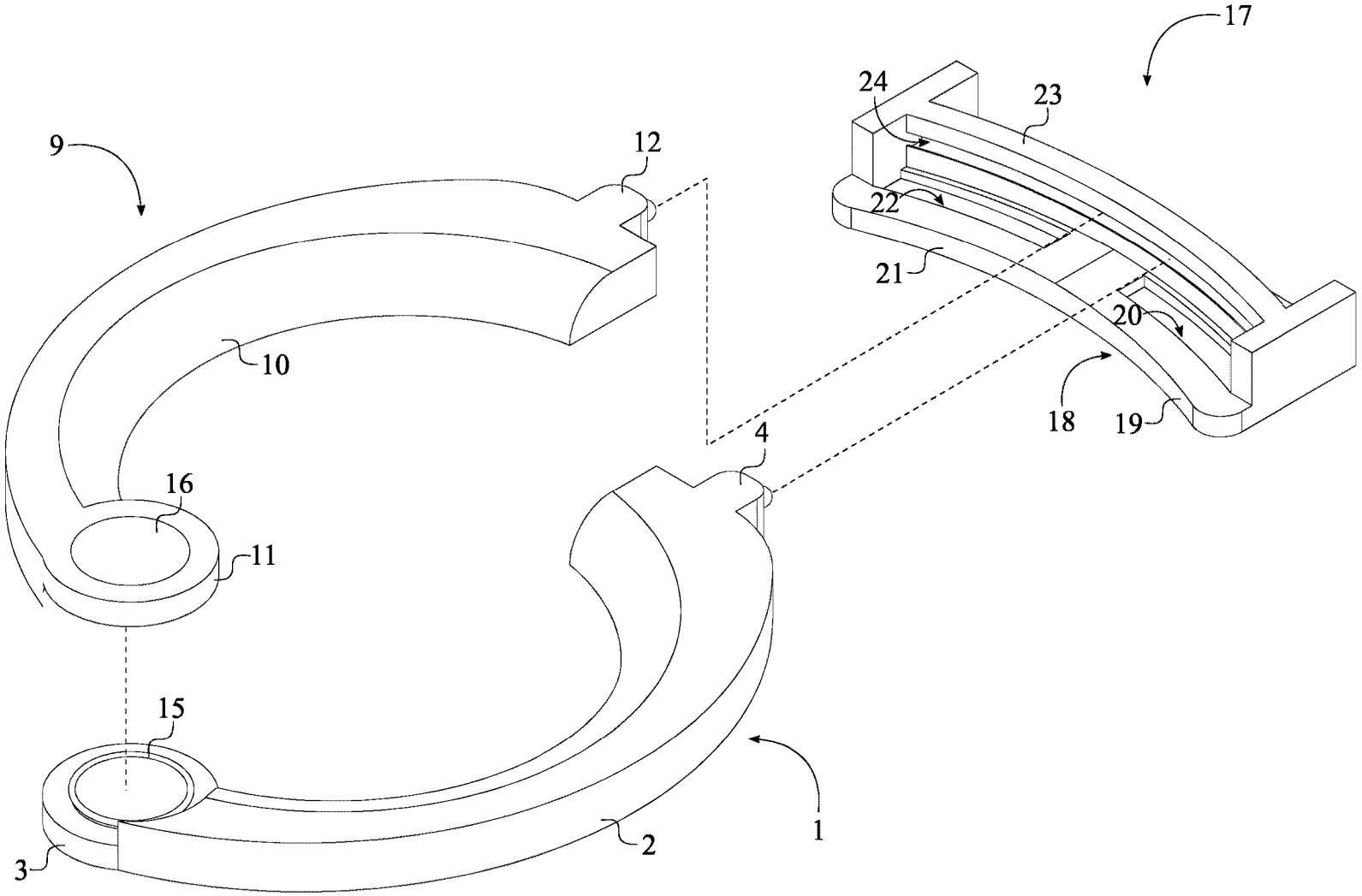
FIG. 5 is an exploded view of the present invention.
Figure 6:
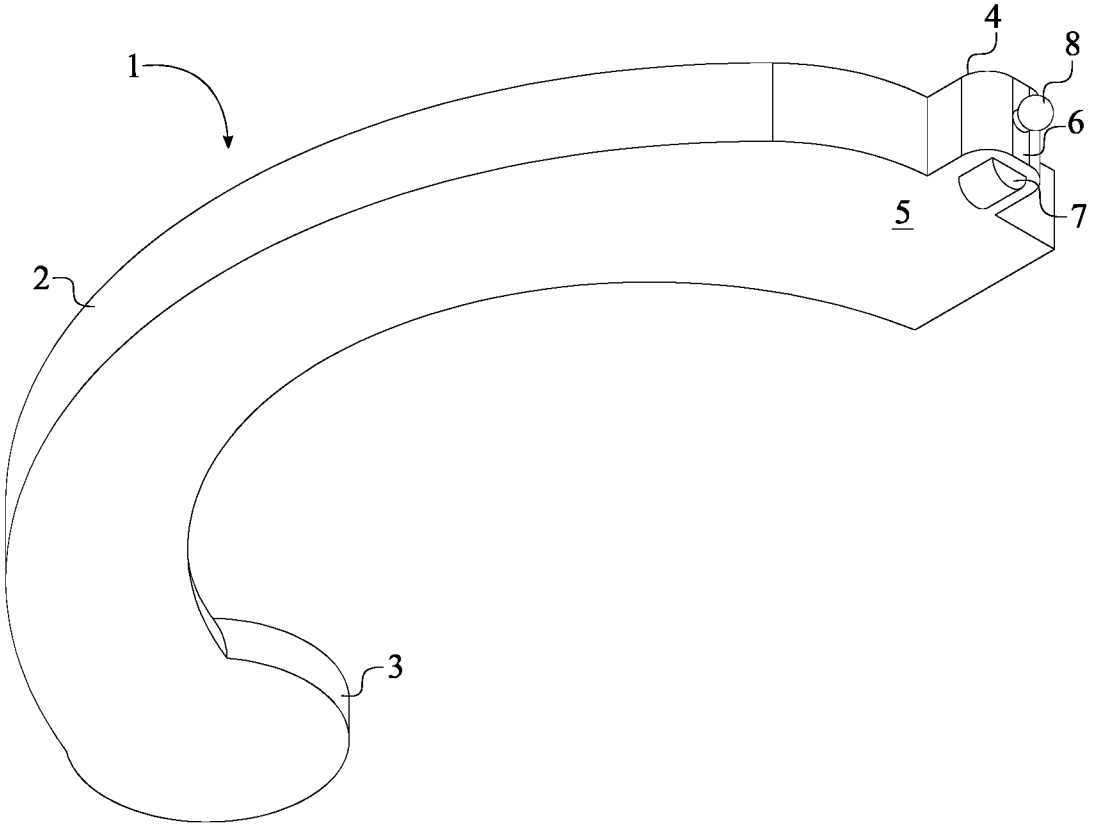
FIG. 6 is a bottom perspective view of the left seat body of the present invention.

In reference to FIG. 5, the seat connector 17 comprises a base plate 18 and a rear plate 23 so that the left wheel 7, the left knob 8, the right wheel 13, and the right knob 14 can be engaged with the seat connector 17. More specifically, the rear plate 23 is perpendicularly connected onto the base plate 18 and shaped into a curved plate in order to compensate for the radial movement of the left seat body 1 and the right seat body 9. Then, the left wheel 7 can be rotatably engaged within the base plate 18, and the right wheel 13 can be rotatably engaged within the base plate 18. Due to the perpendicular positioning, the left knob 8 is slidably engaged within the rear plate 23, and the right knob 14 is slidably engaged within the rear plate 23. In other words, the left seat body 1 is engaged with the seat connector 17 with two different connection points that are the left wheel 7 and the left knob 8. The right seat body 9 is engaged with the seat connector 17 with two different connection points that are the right wheel 13 and the right knob 14.

Figure 8:
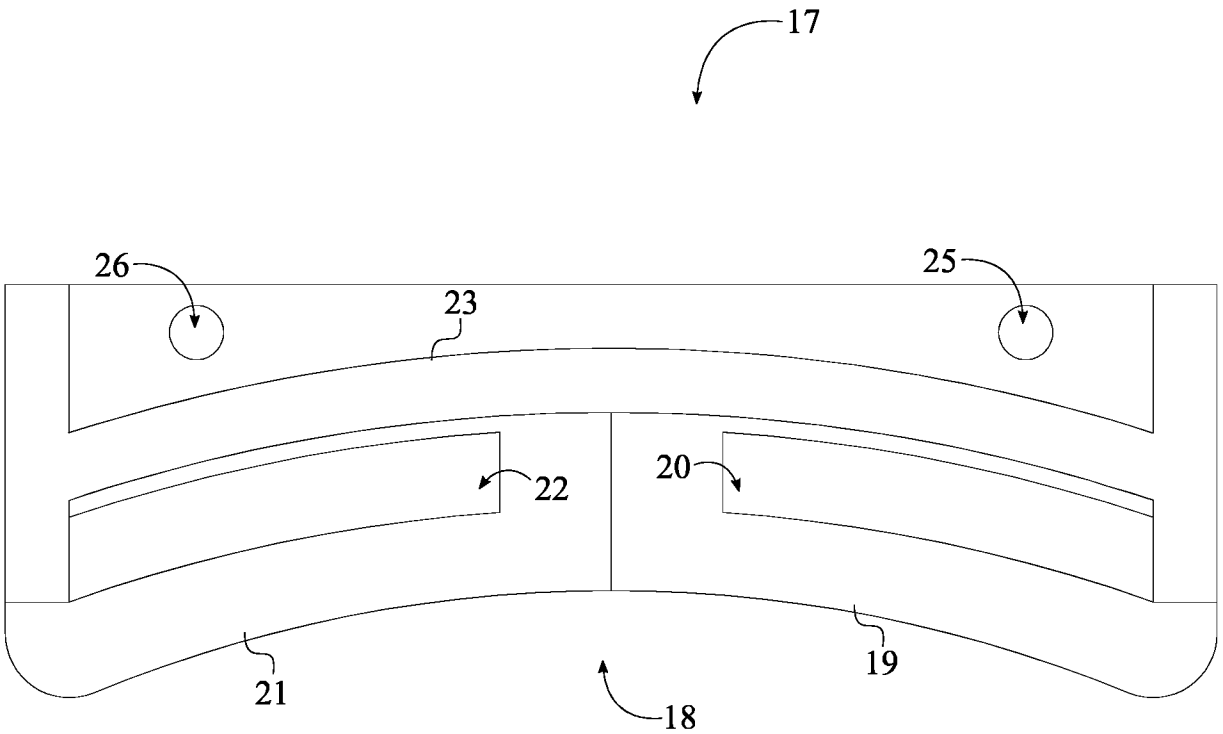
FIG. 8 is a top view of the seat connector of the present invention.
Figure 9:
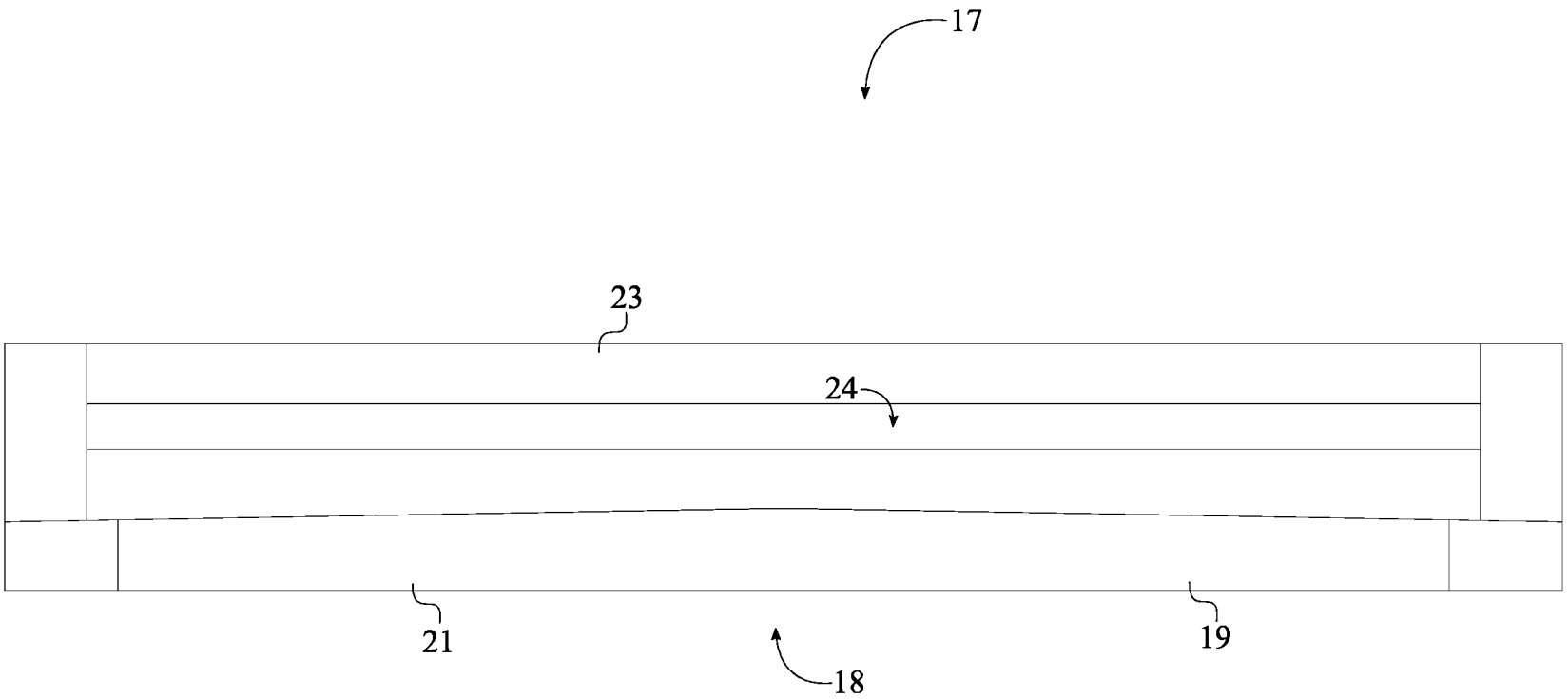
FIG. 9 is a front view of the seat connector of the present invention.

In reference to FIG. 8-9, the base plate 18 comprises a left incline section 19, a left track 20, a right incline section 21, and a right track 22 so that the left seat body 1 and the right seat body 9 can outwardly open about the base plate 18. More specifically, the left incline section 19 and the right incline section 21 are adjacently connected to each other in such a way that a left terminal end and a right terminal end of the base plate 18 is slanted downward. In other words, a height of the base plate 18 along the sagittal plane of the seat connector 17 is higher than a height of the left terminal end and a height of the right terminal end so that the left seat body 1 and the right seat body 9 can slide downward. However, the height of the left terminal end and the height of the right terminal end are equal to each other so that the left seat body 1 and the right seat body 9 can symmetrically expand about the sagittal plane of the seat connector 17.

In reference to FIG. 5 and FIG. 8, the left track 20 traverses into the left incline section 19 so that the left wheel 7 can be rotatably engaged within the left track 20. Similarly, the right track 22 traverses into the right incline section 21 so that the right wheel 13 can be rotatably engaged within the right track 22. The left track 20 and the right track 22 delineate circular cavities within the left incline section 19 and the right incline section 21 so that the radial movement of the left seat body 1 and the right seat body 9 can be accommodated.

In reference to FIG. 5 and FIG. 9, the present invention further comprises a radial track 24 that laterally traverse into the rear plate 23. As a result, the left knob 8 is slidably engaged within the radial track 24, and the right knob 14 is slidably engaged within the radial track 24. The radial track 24 provides a sufficient void space within the rear plate 23 so that the left knob 8 and the right knob 14 can be slidably engaged within the void space. Due to the engagement between the radial track 24, the left knob 8, and the right knob 14, the present invention is able to eliminate the back and forth movement of the left seat body 1 and the right seat body 9 within the present invention. For example, the present invention is able to eliminate the misalignments of the left wheel 7 and the right wheel 13 with respect to the circular profile of the left track 20 and the right track 22.

In reference to FIG. 8, the seat connector 17 further comprising a left seat attachment opening 25 and a right seat attachment opening 26. The left seat attachment opening 25 traverses through the base plate 18 and is positioned adjacent to the left seat body 1. As a result, the left seat attachment opening 25 provides a cavity to insert a fastener that secures the base plate 18 to a left toilet bowl attachment hole of the toilet bowl. Similarly, the right seat attachment opening 26 traverses through the base plate 18 and is positioned adjacent to the right seat body 9. The right seat attachment opening 26 also provide a cavity to insert a fastener that secures the base plate 18 to a right toilet bowl attachment hole of the toilet bowl.

The first self-closing barrel hinge 15 and the second self-closing barrel hinge 16 are torsionally engaged with each other through at least one torsion spring and any other components that may require to proper functionality. The placement of the torsion spring is determined upon industry standard regulations and safety parameters as along as the first self-closing barrel hinge 15 and the second self-closing barrel hinge 16 are able to function as a self-closing hinge or spring-loaded hinge that currently exists within the industry.

Although the invention has been explained in relation to its preferred embodiment, it is to be understood that many other possible modifications and variations can be made without departing from the spirit and scope of the invention as hereinafter claimed.

What is claimed is:

1. An adjustable toilet seat comprising:

a left seat body;

a right seat body;

a first self-closing barrel hinge;

a second self-closing barrel hinge;

a seat connector;

the first self-closing barrel hinge being terminally integrated into the left seat body;

the second self-closing barrel hinge being terminally integrated into the right seat body;

the left seat body and the right seat body being rotatably engaged with each other through the first self-closing barrel hinge and the second self-closing barrel hinge;

the seat connector being oppositely positioned of the first self-closing barrel hinge and the second self-closing barrel hinge;

the left seat body being slidably mounted to the seat connector; and the right seat body being slidably mounted to the seat connector.

2. The adjustable toilet seat as claimed in claim 1 comprising:

the left seat body comprising a left concaved section, a left rotational section, a left arm section, at least one left wheel, and a left knob;

the left rotational section and the left arm section being oppositely positioned of each other about the left concaved section;

the left rotational section and the left concaved section being adjacently connected to each other;

the left arm section being laterally connected to the left concaved section;

the left wheel being rotatably mounted to a bottom surface of the left arm section;

the left knob being laterally connected to a rear surface of the left arm section; and the left wheel and the left knob being perpendicularly positioned of each other.

3. The adjustable toilet seat as claimed in claim 1 comprising:

the right seat body comprising a right concaved section, a right rotational section, a right arm section, at least one right wheel, and a right knob;

the right rotational section and the right arm section being oppositely positioned of each other about the right concaved section;

the right rotational section and the right concaved section being adjacently connected to each other;

the right arm section being laterally connected to the right concaved section;

the right wheel being rotatably mounted to a bottom surface of the right arm section;

the right knob being laterally connected to a rear surface of the right arm section; and the right wheel and the right knob being perpendicularly positioned of each other.

4. The adjustable toilet seat as claimed in claim 1 comprising:

the left seat body comprising a left rotational section;

the right seat body comprising a right rotational section;

the first self-closing barrel hinge being concentrically integrated into the left rotational section;

the second self-closing barrel hinge being concentrically integrated into the right rotational section;

the first self-closing barrel hinge being concentrically positioned atop the second first self-closing barrel hinge; and the first self-closing barrel hinge and the second first self-closing barrel hinge being compressionally engaged with each other.

5. The adjustable toilet seat as claimed in claim 1 comprising:

the seat connector comprising a base plate and a rear plate;

the left seat body comprising at least one left wheel and a left knob;

the right seat body comprising at least one right wheel and a right knob;

the rear plate being perpendicularly connected onto the base plate;

the left wheel being rotatably engaged within the base plate;

the right wheel being rotatably engaged within the base plate;

the left knob being slidably engaged within the rear plate; and the right knob being slidably engaged within the rear plate.

6. The adjustable toilet seat as claimed in claim 1 comprising:

the seat connector further comprising a left seat attachment opening and a right seat attachment opening;

the left seat attachment opening traversing through the base plate;

the left seat attachment opening being positioned adjacent to the left seat body;

the right seat attachment opening traversing through the base plate; and the right seat attachment opening being positioned adjacent to the right seat body.

7. The adjustable toilet seat as claimed in claim 5 comprising:

the base plate comprising a left incline section, a left track, a right incline section, and a right track;

the left incline section and the right incline section being adjacently connected to each other;

the left track traversing into the left incline section;

the right track traversing into the right incline section;

the left wheel being rotatably engaged within the left track; and the right wheel being rotatably engaged within the right track.

8. The adjustable toilet seat as claimed in claim 5 comprising:

a radial track;

the radial track traversing into the rear plate;

the left knob being slidably engaged within the radial track; and the right knob being slidably engaged within the radial track.

* * * * *